US005603606A

United States Patent [19]

Glezer et al.

[11] Patent Number: 5,603,606

[45] Date of Patent: Feb. 18, 1997

[54] TURBINE COOLING SYSTEM

[75] Inventors: Boris Glezer, Del Mar; Tsuhon Lin; Moon Hee-Koo, both of San Diego, all of Calif.

[73] Assignee: Solar Turbines Incorporated, San Diego, Calif.

[21] Appl. No.: 338,071

[22] Filed: Nov. 14, 1994

[51] Int. Cl.[6] ..... F01D 5/18

[52] U.S. Cl. ..... 416/97 R; 415/115

[58] Field of Search ..... 416/95, 96 R, 416/96 A, 97 R; 415/115

[56] References Cited

U.S. PATENT DOCUMENTS

| | | | |
|---|---|---|---|
| 3,528,751 | 9/1970 | Quinones et al. | 416/97 R |
| 3,844,678 | 10/1974 | Sterman et al. | 416/97 R |
| 4,474,532 | 10/1984 | Pazder | 415/115 |
| 4,505,639 | 3/1985 | Groess et al. | 416/96 A |
| 4,767,268 | 8/1988 | Auxier et al. | 416/97 R |
| 5,348,446 | 9/1994 | Lee et al. | 416/97 R |
| 5,356,265 | 10/1994 | Kercher | 416/97 R |
| 5,387,086 | 2/1995 | Frey et al. | 416/97 R |
| 5,403,159 | 4/1995 | Green et al. | 416/97 R |

FOREIGN PATENT DOCUMENTS

| | | | |
|---|---|---|---|
| 2202907 | 10/1988 | United Kingdom | 416/96 R |

*Primary Examiner*—James Larson
*Attorney, Agent, or Firm*—Larry G. Cain

[57] ABSTRACT

Cooling air delivery systems for gas turbine engines are used to increase component life and increase power and efficiencies. The present system increases the component life and increases efficiencies by better utilizing the cooling air bled from the compressor section of the gas turbine engine. For example, a flow of cooling air is directed to a plurality of airfoils having a leading edge and includes a cooling path therein each of the plurality of blades in which is positioned a device which causes the cooling air to swirl and more effectively absorb heat and cool the leading edge of the airfoil.

22 Claims, 4 Drawing Sheets

TURBINE COOLING SYSTEM

TECHNICAL FIELD

This invention relates generally to gas turbine engine cooling and more particularly to the cooling of airfoils such as turbine blades and nozzles.

BACKGROUND ART

High performance gas turbine engines require cooling passages and cooling flows to ensure reliability and cycle life of individual components within the engine. For example, to improve fuel economy characteristics engines are being operated at higher temperatures than the material physical property limits of which the engine components are constructed. These higher temperatures, if not compensated for, oxidize engine components and decrease component life. Cooling passages are used to direct a flow of air to such engine components to reduce the high temperature of the components and prolong component life by limiting the temperature to a level which is consistent with material properties of such components.

Conventionally, a portion of the compressed air is bled from the engine compressor section to cool these components. Thus, the amount of air bled from the compressor section is usually limited to insure that the main portion of the air remains for engine combustion to perform useful work.

As the operating temperatures of engines are increased, to increase efficiency and power, either more cooling of critical components or better utilization of the cooling air is required.

The present invention is directed to overcome one or more of the problems as set forth above.

DISCLOSURE OF THE INVENTION

In one aspect of the present invention, a cooling air delivery system for cooling components of a gas turbine engine having a turbine section, a compressor section and a compressor discharge plenum fluidly connecting the air delivery system to the compressor section therein. The cooling air delivery system is comprised of a fluid flow path which interconnects the compressor discharge plenum with the engine components to be cooled and has a cooling fluid flowing therethrough when the compressor section is in operation. The system is further comprised of a plurality of airfoils which have a leading edge, a trailing edge, a first cooling path and a second cooling path therein. Each of the first and second cooling paths are internally separated and have a cooling fluid flowing therethrough and exiting the airfoil. The second cooling path is adjacent the leading edge and has a swirling means therein.

In another aspect of the invention, an airfoil has a generally hollow configuration forming a peripheral wall and includes a first end, a second end positioned opposite the first end, a leading edge, a trailing edge positioned opposite the leading edge, a suction side having a convex configuration extending between the leading edge and the trailing edge and a pressure side having a concave configuration extending between the leading edge and the trailing edge. The airfoil is comprised of a cooling path being interposed the leading edge and the trailing edge and a means for swirling a flow of cooling fluid within the cooling path during operation of the airfoil.

BEST MODE FOR CARRYING OUT THE INVENTION

Figure 1:
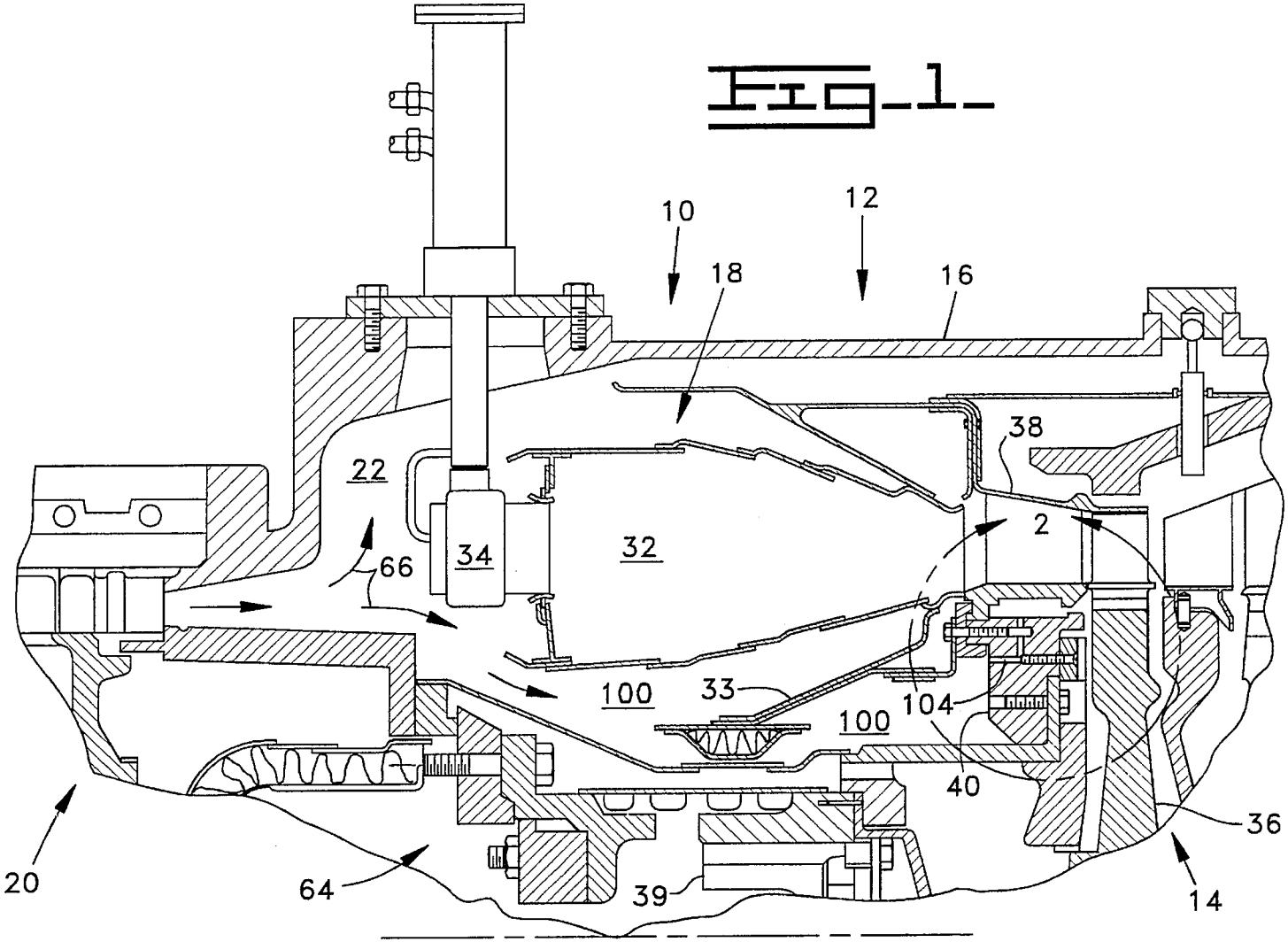
FIG. 1 is a sectional side view of a portion of a gas turbine engine embodying the present invention.

Referring to FIG. 1, a gas turbine engine 10, not shown in its entirety, has been sectioned to show a cooling air delivery system 12 for cooling components of a turbine section 14 of the engine. The engine 10 includes an outer case 16, a combustor section 18, a compressor section 20, and a compressor discharge plenum 22 fluidly connecting the air delivery system 12 to the compressor section 20. The compressor section 20, in this application, is a multistage axial compressor although only a single stage is shown. The combustor section 18 includes a plurality of combustion chambers 32 supported within the plenum 22 by a plurality of supports 33, only one shown. A plurality of fuel nozzles 34 (one shown) are positioned in the plenum 22 at the end of the combustion chamber 32 near the compressor section 20. The turbine section 14 includes a first stage turbine 36 disposed partially within an integral first stage nozzle and shroud assembly 38. The assembly 38 is supported from a center housing 39 by a series of thermally varied masses 40.

The cooling air delivery system 12, for example, has a fluid flow path 64 interconnecting the compressor discharge plenum 22 with the turbine section 14. During operation, a fluid flow, designated by the arrows 66, is available in the fluid flow path 64. The fluid flow path 64 further includes an internal passage 100 positioned within the gas turbine engine 10. The flow of cooling fluid 66 is directed therethrough from the compressor section 20 to the turbine section 14. For example, a portion of the internal passage 100 is intermediate the center housing 39 and the combustion chamber support 33. Each of the combustion chambers 32 are radially disposed in spaced apart relationship within the plenum 22 and has clearance therebetween for the flow of cooling fluid 66 to pass therethrough. The flow path 64 for the flow of cooling fluid further includes a plurality of passages 104 in the varied masses 40.

Figure 2:
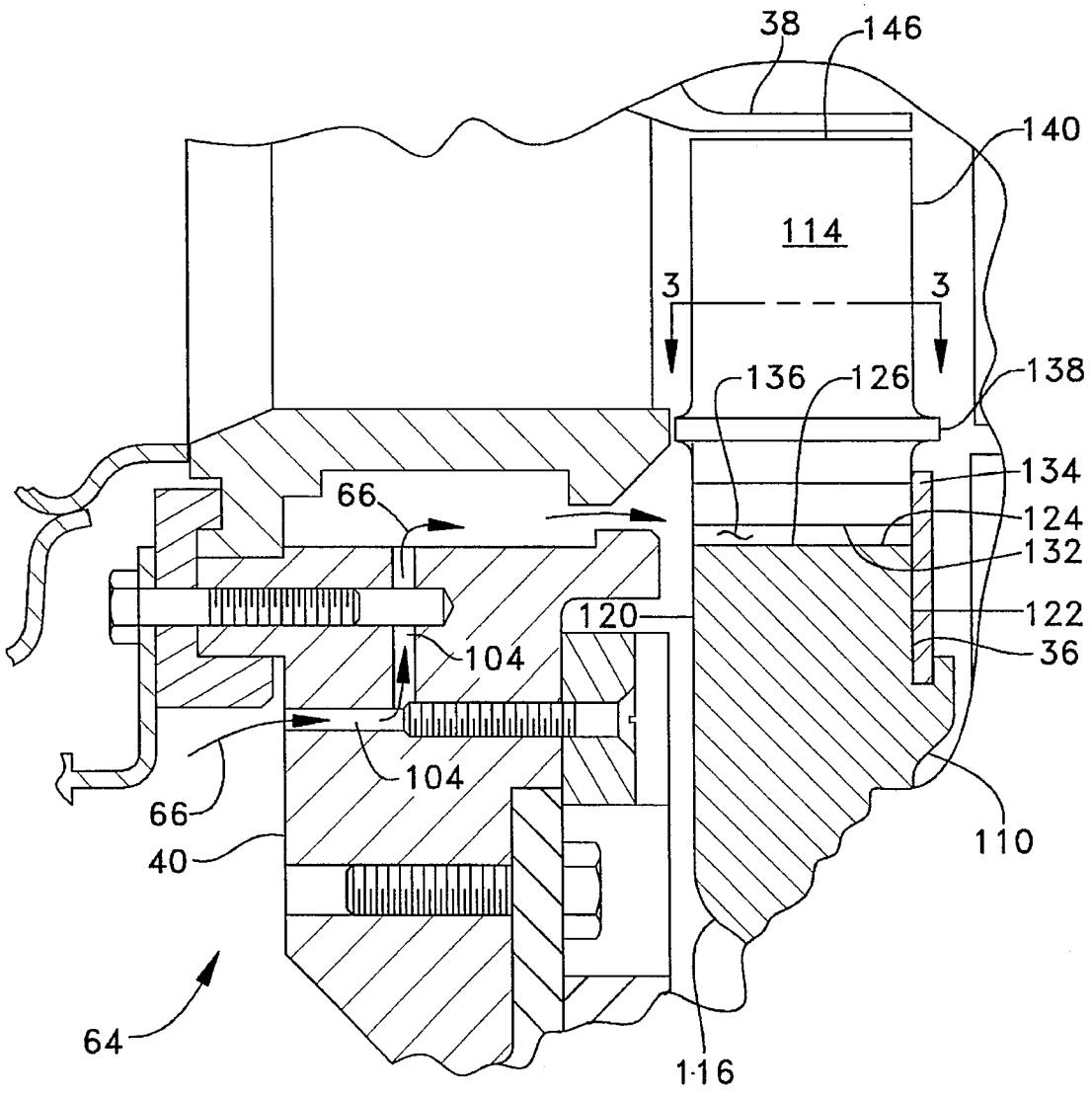
FIG. 2 is an enlarged sectional view of a portion of FIG. 1 taken along lines 2—2 of FIG. 1.

As best shown in FIG. 2, the turbine section 14 is of a generally conventional design. For example, the first stage turbine 36 includes a rotor assembly 110 disposed axially adjacent the nozzle and shroud assembly 38. The rotor assembly 110 is generally of conventional design and has a plurality of turbine blades 114 positioned therein. Each of the turbine blades 114 are made of any conventional material; however, each of the plurality of blades could be made of a ceramic material without changing the essence of the invention. The rotor assembly 110 further includes a disc 116 having a first face 120 and a second face 122. A plurality of circumferentially arrayed retention slots 124 are positioned in the disc 116. Each of the slots 124, of which only one is shown, extends from one face 120 to the other face 122, has a bottom 126 and has a pair of side walls (not shown) which are undercut in a conventional manner. The plurality of blades 114 are replaceably mounted within the disc 116. Each of the plurality of blades 114 includes a first end 132 having a root section 134 extending therefrom which engages with one of the corresponding slots 124. The first end 132 is spaced away from the bottom 126 of the slot 124 in the rotor 112 and forms a gallery 136. Each blade 114 has a platform section 138 disposed radially outwardly from the periphery of the disc 116 and the root section 134. Extending radially outward from the platform section 138 is a reaction section 140. Each of the plurality of turbine blades 114 includes a second end 146, or tip, positioned opposite the first end 132 and adjacent the reaction section 140.

Figure 3:
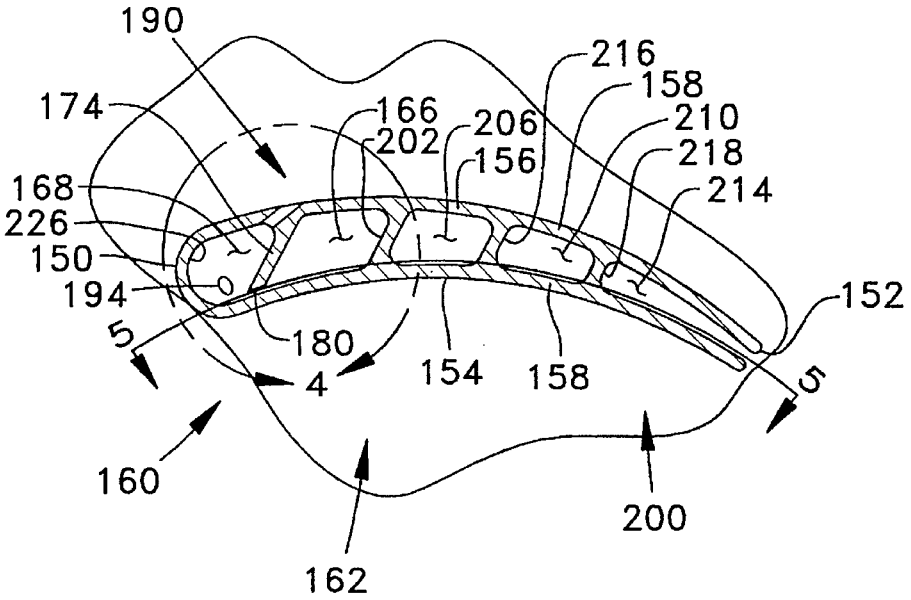
FIG. 3 is an enlarged sectional view of a turbine blade taken along lines 3—3 of FIG. 2.
Figure 4:
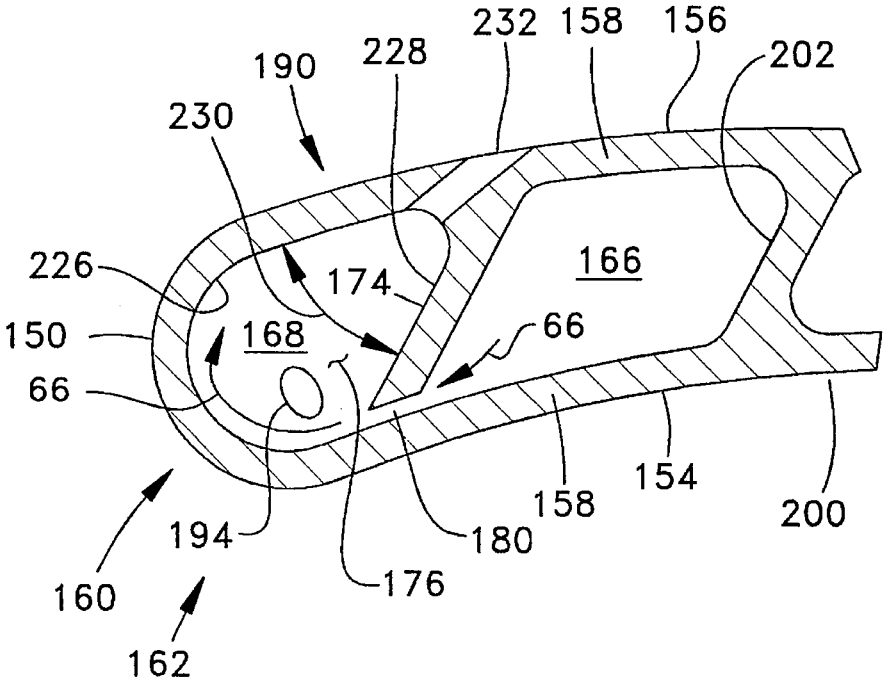
FIG. 4 is an enlarge sectional view taken through a portion of a turbine blade along line 4 of FIG. 3.
Figure 5:
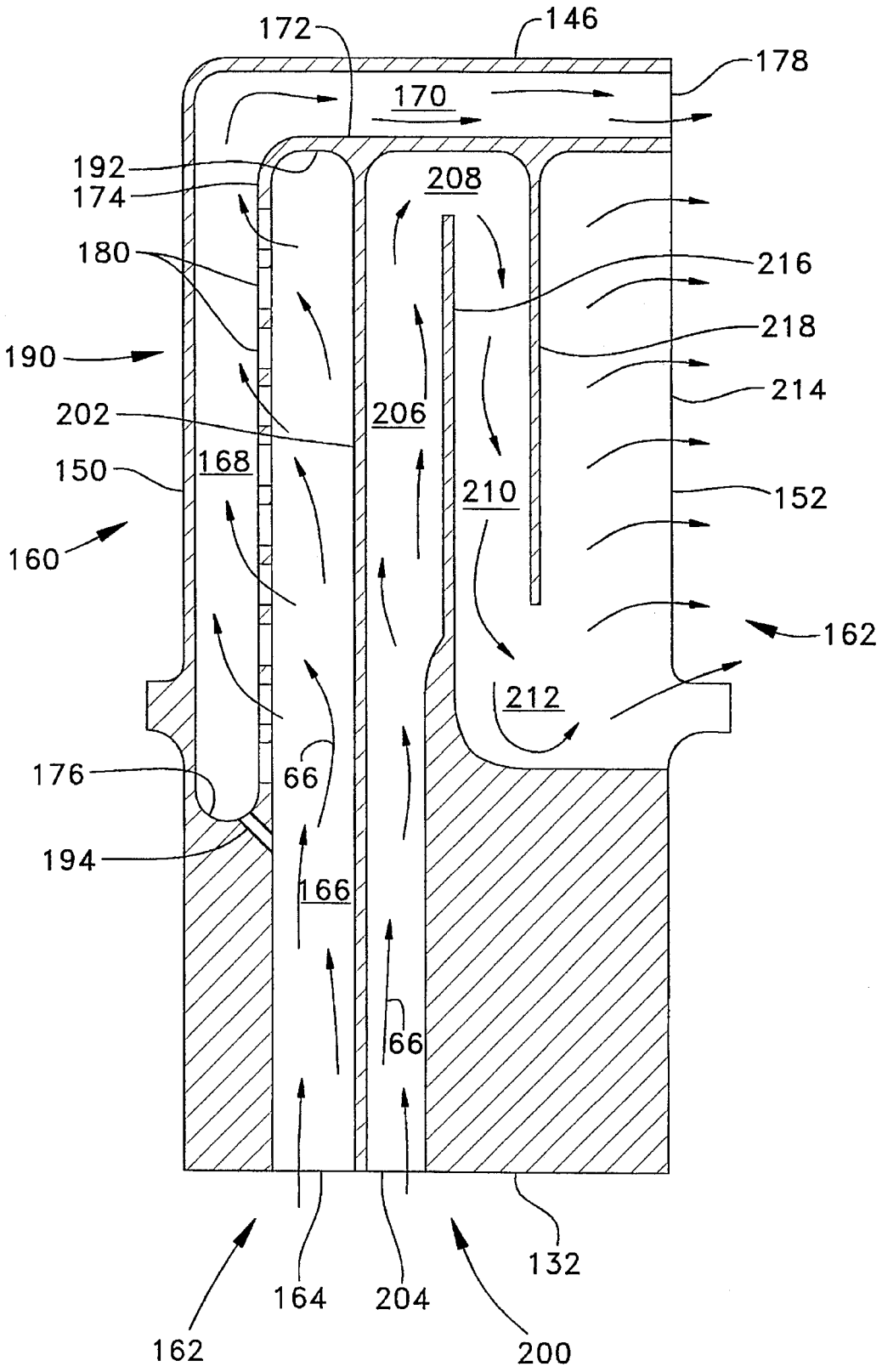
FIG. 5 is an enlarged sectional view of the turbine blade taken along lines 5—5 of FIG. 3.

As is more clearly shown in FIGS. 3, 4 and 5, each of the plurality of turbine blades 114 includes a leading edge 150 which, in the assembled condition, is positioned adjacent the nozzle assembly 38 and a trailing edge 152 positioned opposite the nozzle assembly 38. Interposed the leading edge 150 and the trailing edge 152 is a pressure or concave side 154 and a suction or convex side 156. Each of the plurality of blades 114 has a generally hollow configuration forming a peripheral wall 158 having a generally uniform thickness.

A means 160 for internally cooling each of the blades 114 is provided to extend the operating temperature of the gas turbine engine 10. The means 160 for cooling, in this application, includes a pair of cooling paths being separated one from the other. However, any number of cooling paths could be used without changing the essence of the invention.

A first cooling path 162 is positioned within the peripheral wall 158 and is interposed the leading edge 150 and the trailing edge 152 of each of the blades 114. The first cooling path 162 includes an inlet opening 164 originating at the first end 132 and has a first radial gallery 166 extending outwardly substantially the entire length of the blade 114 toward the second end 146. The inlet opening 164 and the first radial gallery 166 are interposed the leading edge 150 and the trailing edge 152. Further included in the first cooling path 162 is a second radial gallery 168 extending between the first end 132 and the second end 146 and being in communication with a horizontal gallery 170 being at least partially interposed the second end 146 and the first radial gallery 166 by a first partition 172 which is connected to the peripheral wall 158 at the concave side 154 and the convex side 156. The second radial gallery 168 is interposed the leading edge 150 and the first radial gallery 166 by a second partition 174. The second partition 174 is connected to the peripheral wall 158 at the concave side 154 and the convex side 156. The second radial gallery 168 has an end 176 adjacent the first end 132 of the blade 114 and is opposite the end communicating with the horizontal gallery 170. The horizontal gallery 170 communicates with an exit opening 178 disposed in the trailing edge 152. A plurality of holes or a slot 180 are positioned in the second partition 174 and communicate between the first radial gallery 166 and the second radial gallery 168 and form a means 190 for swirling a portion of the fluid flowing through the turbine blade 114. As shown in FIGS. 3 and 4, the plurality of holes 180 are positioned adjacent the peripheral wall 158 near the pressure side 154 of each of the blades 114. The plurality of holes 180 extends radial between the end 176 of the second radial gallery 168 and an end 192 of the first radial gallery 166 positioned opposite the first end 132 of the blade 114. As an alternative, an additional angled passage 194 extends between the first radial gallery 166 and the second radial gallery 168. The angled passage 194 enters the end 176 of the second radial passage at an angle of about 30 to 60 degrees.

A second cooling path 200 is positioned within the peripheral wall 158 and is interposed the first cooling path 162 and the trailing edge 152 of each blade 114. The second cooling path 200 is separated from the first cooling path 162 by a first wall member 202. The second cooling path 200 includes an inlet opening 204 originating at the first end 132 and has a first radial passage 206 extending outwardly substantially the entire length of the blade 114 toward the second end 146. The inlet opening 204 and the first radial passage 206 are interposed the first cooling path 162 and the trailing edge 152. Further included is a first horizontal passage 208 positioned inwardly of the horizontal gallery 170 of the first cooling path 162 and is in communication with the first radial passage 206 and a second radial passage 210. The second radial passage 210 extends inwardly from the first horizontal passage 208 to a second horizontal passage 212. The second horizontal passage 212 communicates with a generally radial outlet passage 214 disposed in the trailing edge 152. The first radial passage 206 is separated from the second radial passage 210 by a second wall member 216 which is connected to the peripheral wall 158 at the concave side 154 and the convex side 156. The second radial passage 210 is separated from the radial outlet passage 214 by a third wall member 218 which is also connected to the peripheral wall 158 at the concave side 154 and the convex side 156.

A cross-sectional view of the second radial gallery 168 has a preestablished cross-sectional configuration. As best shown in FIG. 4, disclosed is a generally arcuate portion 226 adjacent the leading edge 150, a generally straight portion 228 following along the wall 174 and the intersection therebetween forming an angle 230 which, in this application, is an acute angle of between 45 and 60 degrees. As further shown in FIG. 4, a plurality of opening 232, of which only one is shown, have a preestablished area and communicates between the second radial gallery 168 and the suction side 156 of the blade 114. For example, the preestablished area of the plurality of openings is about 50 percent of the preestablished cross-sectional area of the second radial gallery 168. The plurality of openings 232 exit the suction side 156 at an incline angle generally directed from the leading edge 150 toward the trailing edge 152. A preestablished combination of the plurality of holes 232 having a preestablished area forming a flow rate and the plurality of holes 180 having a preestablished area forming a flow rate provides an optimized cooling effectiveness for the blade 114.

The above description is of only the first stage turbine 36; however, it should be known that the construction could be generally typical of the remainder of the turbine stages within the turbine section 14 should cooling be employed. Furthermore, although the cooling air delivery system 12 has been described with reference to a turbine blade 114 the system is adaptable to any airfoil such as the first stage nozzle and shroud assembly 38 without changing the essence of the invention.

Industrial Applicability

In operation, the reduced amount of cooling fluid or air from the compressor section 20 as used in the delivery system 12 results in an improved efficiency and power of the gas turbine engine 10 while increasing the longevity of the components used within the gas turbine engine 10. The following operation will be directed to the first stage turbine 36; however, the cooling operation of the remainder of the airfoils (blades and nozzles) could be very similar if cooling is used. A portion of the compressed air from the compressor section 20 is bled therefrom forming the flow of cooling fluid 66 used to cool the first stage turbine blades 114. The air exits from the compressor section 20 into the compressor discharge plenum 22 and enters into a portion of the fluid flow path 64. The flow of cooling air 66 is used to cool and prevent ingestion of the hot power gases into the internal components of the gas turbine engine 10. For example, the air bled from the compressor section 20 flows into the compressor discharge plenum 22, through the internal passages 100 or areas between the plurality of combustion chambers 32 and into the plurality of passages 104 in the varied masses 40. After passing through the plurality of passages 104 in the masses 40, the cooling air enters into the gallery 136 or space between the first end 132 of the blade 114 and the bottom 126 of the slot 124 in the disc 116.

A portion of the cooling air 66 from the internal passage 100 enters the first cooling path 162. For example, cooling fluid 66 enters the inlet opening 164 and travels radially along the first radial gallery 166 absorbing heat from the peripheral wall 158 and the partition 172. The majority of the cooling fluid 66 exits the first radial gallery 166 through the plurality of holes 180 and creating a swirling flow which travels radially along the arcuate portion 226 of the second radial gallery 168 absorbing the highest amount of heat from the leading edge 150 of the peripheral wall 158. The swirling action caused by the swirling means 190, the position and directional location of the plurality of holes 180 and the arcuate configuration of the arcuate portion 226 of the second radial gallery 168 along with the flow of cooling fluid through the angled passage 194, cause the cooling fluid 66 to generate an intensive vortex flow in the second radial gallery 168. The vortex flow leads to high local turbulence (vortices) along the arcuate portion 226 adjacent the leading edge 150 of the turbine blade 114. The portion of the cooling fluid 66 entering the angled passage 194 between the first radial gallery 166 and the second radial gallery 168, as stated above, adds to the vortex flow by directing the cooling fluid 66 generally radially outward from second radial gallery 168 into the horizontal gallery 170. The combination of the angled passage 194 and the swirling means 190 cause the cooling fluid 66 to take on a screw type action, from the end 176 toward the horizontal gallery 170, adding to the cooling efficiency of the cooling delivery system 12. A portion of the cooling fluid 66 exits the plurality of openings 232 cooling the skin of the peripheral wall 158 in contact with the combustion gases on the suction side 156 prior to mixing with the combustion gases. The remainder of the cooling fluid 66 in the first cooling path 162 exits the exit opening 178 in the trailing edge 152 to also mix with the combustion gases.

A second portion of the cooling air 66 enters the second cooling path 200. For example, cooling fluid 66 enters the inlet opening 204 and travels radially along the first radial passage 206 absorbing heat from the peripheral wall 158, the first wall member 202 and the second wall member 216 before entering the first horizontal passage 208 where more heat is absorbed from the peripheral wall 158. As the cooling fluid 66 enters the second radial passage 210 additional heat is absorbed from the peripheral wall 158, the first wall member 202 and the second wall member 216 before entering the second horizontal passage 212 and exiting the radial outlet passage 214 along the trailing edge 152 to be mixed with the combustion gases.

Thus, the primary advantages of the improved turbine cooling system 12 is to provide a more efficient use of the cooling air bled from the compressor section 20, increase the component life and efficiency of the engine. The swirling means 190 contributes to the efficiency of the cooling air flow 66 as the cooling fluid passes through the turbine blade 114. The efficiency is especially improved within the internal portion of the turbine blade 114 along the leading edge 150.

Other aspects, objects and advantages of this invention can be obtained from a study of the drawings, the disclosure and the appended claims.

We claim:

1. A cooling air delivery system for cooling components of a gas turbine engine having a compressor section and a compressor discharge plenum fluidly connecting the air delivery system to the compressor section comprising:

a fluid flow path interconnecting the compressor discharge plenum with the engine components to be cooled and having a cooling fluid flowing therethrough when the compressor section is in operation;

a plurality of airfoils having a hollow configuration, a leading edge, a trailing edge, a first cooling path and a second cooling path therein, each of said first and second cooling paths being internally separated and having a cooling fluid flowing therethrough and exiting each of the plurality of airfoils; and said first cooling path being adjacent the leading edge and having a swirling means therein, said swirling means causing the cooling fluid to have a radially outward screw type action.

2. The cooling air delivery system of claim 1 wherein each of said plurality of airfoils has a first end and said first and second cooling paths each have an inlet opening originating at said first end.

3. The cooling air delivery system of claim 1 wherein said first cooling path includes a first radial gallery and a second radial gallery positioned within the airfoil, said first radial gallery being separated from said second radial gallery by a partition and a plurality of holes communicates between the first radial gallery and the second radial gallery.

4. The cooling air delivery system of claim 3 wherein said hollow configuration of the airfoil is defined by a peripheral wall and said plurality of holes are positioned in the partition and adjacent the peripheral wall.

5. The cooling air delivery system of claim 4 wherein said airfoil further includes a suction side and a pressure side interposed the leading edge and the trailing edge and said plurality of holes is positioned adjacent the pressure side of the peripheral wall.

6. The cooling air delivery system of claim 4 wherein said second radial gallery includes a generally arcuate portion positioned adjacent the leading edge, a straight portion following along the partition and has an angle formed therebetween.

7. The cooling air delivery system of claim 6 wherein said first radial gallery is in communication with the trailing edge and said flow of cooling fluid through said first radial gallery is communicated from the first radial gallery through the plurality of holes generally along the arcuate portion and along the straight portion prior to exiting the trailing edge.

8. The cooling air delivery system of claim 3 wherein said second radial gallery has an end and an angled passage enters the end and extends between the first radial gallery and the second radial gallery.

9. An airfoil having a hollow configuration forming a peripheral wall and including a first end, a second end positioned opposite the first end, a leading edge, a trailing edge positioned opposite the leading edge, a suction side extending between the leading edge and the trailing edge and a pressure side extending between the leading edge and the trailing edge comprising:

a cooling path being interposed the leading edge and the trailing edge; and a swirling device in which a flow of cooling fluid within the cooling path occurs during operation of the airfoil, said swirling device causing the cooling fluid to have generally a radially outward screw type action.

10. The airfoil of claim 9 wherein said cooling path includes a inlet opening originating at the first end, a first radial gallery being in communication with the inlet opening and extending generally along the entire length of the airfoil, a second radial gallery extending between the first end and the second end and having an end being in communication with a horizontal gallery adjacent one of the ends and communicating with an exit opening disposed in the trailing edge, said first radial gallery and said second radial gallery being separated by a partition and said first radial gallery and said second radial gallery having a plurality of holes communicating therebetween.

11. The airfoil of claim 10 wherein said cooling path further includes a passage communicating between the first radial gallery and the second radial gallery.

12. The airfoil of claim 11 wherein said passage is angled to the end of the second radial gallery.

13. The airfoil of claim 12 wherein said angle of the passage to the end is between about 45 and 60 degrees.

14. The airfoil of claim 10 wherein said plurality of holes are positioned adjacent the peripheral wall near the one of the suction side and the pressure side.

15. The airfoil of claim 14 wherein said plurality of holes are positioned adjacent the peripheral wall near the pressure side.

16. The airfoil of claim 9 wherein said cooling path includes a first cooling path and a second cooling path, said first and second cooling paths having a flow of cooling fluid flowing therethrough during operation and said flow of cooling fluid being a separate cooling flow in each of the first cooling path and the second cooling path.

17. The airfoil of claim 9 wherein said cooling path further includes a plurality of openings exiting the suction side.

18. The airfoil of claim 17 wherein said plurality of openings are formed at an angle generally inclining from the leading edge toward the trailing edge.

19. The airfoil of claim 17 wherein said plurality of openings have a preestablished area and said cooling path includes a first radial gallery and a second radial gallery, said second radial gallery having a preestablished cross-sectional area and said preestablished area of the plurality of openings is about 50 percent of the preestablished cross-sectional area of the second radial gallery.

20. The airfoil of claim 9 wherein said cooling path includes a plurality of openings communicating through the peripheral wall and wherein during operation a flow of cooling fluid exits from the airfoil through the plurality of openings.

21. An airfoil having a hollow configuration forming a peripheral wall and including a first end, a second end positioned opposite the first end, a leading edge, a trailing edge positioned opposite the leading edge, a suction side extending between the leading edge and the trailing edge and a pressure side extending between the leading edge and the trailing edge comprising:

a cooling path being interposed the leading edge and the trailing edge, said cooling path being unobstructed; and a swirling device wherein a flow of cooling fluid within the cooling path occurs during operation of the airfoil, said swirling device causing the cooling fluid to flow generally from the first end radially outward toward the second end and having a screw type action being in communication with the peripheral wall.

22. The airfoil of claim 21 wherein said cooling path includes a first cooling path and a second cooling path.

* * * * *

UNITED STATES PATENT AND TRADEMARK OFFICE

CERTIFICATE OF CORRECTION

PATENT NO. : 5,603,606

DATED : February 18, 1997

INVENTOR(S) : Boris Glezer, et al.

It is certified that error appears in the above-identified patent and that said Letters Patent is hereby corrected as shown below:

On the title page, item [75],
The inventor's name of Moon Hee-Koo should be changed to read Hee-Koo Moon.

Signed and Sealed this

Ninth Day of December, 1997

Bruce Lehman

*Attest:*

BRUCE LEHMAN

*Attesting Officer*

*Commissioner of Patents and Trademarks*